US006785988B2

(12) United States Patent
Lammer et al.

(10) Patent No.: US 6,785,988 B2
(45) Date of Patent: Sep. 7, 2004

(54) DRIVING OR MINING MACHINE

(75) Inventors: Egmont Lammer, Knittelfeld (AT); Ralf Grief, Zeltweg (AT); Karl Lerchbaum, Zeltweg (AT); Reinhard Neuper, Judenburg (AT)

(73) Assignee: Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 10/131,751

(22) Filed: Apr. 24, 2002

(65) Prior Publication Data

US 2002/0157283 A1 Oct. 31, 2002

(30) Foreign Application Priority Data

Apr. 25, 2001 (AT) ..... GM324/2001 U

(51) Int. Cl.[7] ..... E21D 15/00
(52) U.S. Cl. ..... 37/324; 299/11
(58) Field of Search ..... 37/242, 244, 248, 37/307–324; 405/259, 303; 299/11, 12, 33, 64, 67, 70; 175/402–404; 408/204–207, 238

(56) References Cited

U.S. PATENT DOCUMENTS 3,493,058 A * 2/1970 Zitko ..... 173/189
4,680,879 A * 7/1987 Hill et al. ..... 37/331
4,753,486 A * 6/1988 LeBegue ..... 299/11
4,865,390 A 9/1989 Shrader et al.
5,816,750 A * 10/1998 Steffenino ..... 405/302.3
6,494,276 B1 * 12/2002 Hamilton et al. ..... 175/403

FOREIGN PATENT DOCUMENTS

EP 0216506 B1 10/1990 ..... E21D/20/00

* cited by examiner

*Primary Examiner*—Robert E Pezzuto
(74) *Attorney, Agent, or Firm*—Chapman and Cutler LLP

(57) ABSTRACT

A driving or mining machine includes a pivotable cantilever arm that is hinged so as to be pivotable in the height direction to a pivoting mechanism capable of being pivoted about a substantially vertical axis and on its free end carries rotationally mounted excavation tools, in particular cutter heads. It further includes a traveling mechanism and a frame carrying the traveling mechanism, on which frame a haulage device and a suction device as well as anchor boring and setting devices are arranged. The frame carrying the traveling mechanism on its side facing away from the cantilever arm behind the pivoting mechanism is designed as a lowered platform. The anchor boring and setting device is arranged substantially in the longitudinal center of the frame above the platform and pivotally mounted on a rollover whose pivot axis crosses the vertical axis of the pivoting mechanism. The pivot angle of the anchor boring and setting device is larger than 180° and extends to below the horizontal plane containing the pivot axis of the rollover.

23 Claims, 3 Drawing Sheets

DRIVING OR MINING MACHINE

BACKGROUND OF THE INVENTION

1. Field of the Invention

The invention relates to a driving or mining machine including a pivotable cantilever arm which is hinged so as to be pivotable in the height direction to a pivoting mechanism capable of being pivoted about a substantially vertical axis and on its free end carries rotationally mounted excavation tools, in particular cutter heads, and including a traveling mechanism and a frame carrying the traveling mechanism, on which frame a haulage means and a suction means as well as anchor boring and setting devices are arranged.

2. Prior Art

Driving machines of the initially defined kind have become known in various designs. In accordance with the set object, which resides in securing the driven track against falling-down material, different configurations have already been proposed as a function of the nature of the respective rock. In detail, DE 33 34 975 A1 discloses a driving machine in which anchor boring and setting devices are hinged to the cutting machine and laterally connected with the cutting machine via rod assemblies, wherein the respective connection is designed as a horizontally movable holding means. In the respective operating position, the anchor boring and optionally setting machine in that device was braced against lateral walls and roofs by means of a prop, whereby the machine, upon bracing of the anchor boring and setting device, could be moved on in conformity with the horizontal mobility of the holding means. Due to this lateral articulation, such an anchor boring and setting device naturally renders feasible the provision of an anchor bore, or the setting of an anchor, only laterally beside the machine, thus preventing the realization of, in particular, central roof anchors as well as anchor bores in the region of the floor by means of such a device. In other types of construction it has already been proposed to brace the anchor boring and setting device not separately between roof and floor, and a configuration is known, particularly from EP 216 506, in which anchor boring and setting devices are arranged in the lateral region of the machine above the machine frame substantially in the horizontal mass center of gravity of the driving machine. Yet, not even such lateral devices allow the setting of bores distributedly about the total periphery of the floor and roof, wherein the haulage means on the site of the center of mass projects already relatively far over the floor in the region of the longitudinal central axis of the machine such that impediments of the pivotal movements have to be taken into account.

Special devices in which the anchor boring and setting devices were arranged in the region near the mine face and were again braced between the front end of the machine and, in particular, the loading device, and the roof were proposed for extremely short-structured machines. Again, a plurality of anchor boring and setting devices were distributed over the pallet of the machine and braced against the roof, yet such devices did not allow the realization, in particular, of bores close to the floor. In all known cases anchor setting patterns are limited, because only either individual anchors or a plurality of anchors can be introduced perpendicularly into the roof. The known machines are designed for special purposes of use and, if the anchor boring and setting devices are not arranged on the rear end or behind the rear end of the traveling mechanism, as a rule comprise special short-structured excavation tools and are not readily adaptable to cantilever arms offering universal mobility.

SUMMARY OF THE INVENTION

The invention aims to provide a driving or mining machine of the initially defined kind, in which the flexibility of excavation will not be impeded in any manner whatsoever by using a pivoting arm capable of being pivoted about a substantially vertical axis and hinged so as to be pivotable in the height direction in order to enable the driving of different rocks by one and the same machine and facilitate the maneuverability of the machine to move the same to different sites of excavation. In a machine of this type, the invention aims to do without any separate bracing of anchor boring and setting devices and, at the same time, enable the setting of any desired bores from the floor over the roof by means of such an anchor boring and setting device without having to put up with machine-related restrictions. The driving and mining machine according to the invention is, thus, to enable anchoring for the universal use of a driving machine comprising a cutter boom and a cutter head or cutting roll, since anchors can, in fact, be introduced also during the cutting procedure and set over the total track section. At the same time, the structural height of the driving machine is not to be substantially exceeded despite additional devices such as, for instance, the anchor boring and setting device and suction means, in order to safeguard the displaceability of the machine. To solve this object, the driving or mining machine according to the invention essentially consists in that the frame carrying the traveling mechanism on its side facing away from the cantilever arm behind the pivoting mechanism is designed as a lowered platform, that the anchor boring and setting device is arranged substantially in the longitudinal center of the frame above the platform and pivotally mounted on a rollover whose pivot axis crosses the vertical axis of the pivoting mechanism, and that the pivot angle of the anchor boring and setting device is larger than 180° and extends to below the horizontal plane containing the pivot axis of the rollover, wherein means preferably arranged below this horizontal plane and, in particular, the suction means are designed to be pivotable in the pivoting range of the anchor boring and setting device or to be reducible to smaller cross sections. Due to the fact that a lowered platform is formed behind the pivoting mechanism on the side facing away from the cantilever arm, the space required to arrange an anchor boring and setting device with a large pivotability is created in a relatively stable region of the hewing machine, thus enabling bores to be provided in a distributed manner both near the floor and over the roof. By the anchor boring and setting device being arranged substantially in the longitudinal center of the frame above the platform and steerably mounted on a rollover, it is feasible to set also central roof anchors in a simple manner, whereby the accordingly lowered platform enables the rollover to be positioned relatively closely above the plane of the floor such that the lateral walls and the roof can be swept over completely. Since the rollover is designed in a manner that the pivot axis crosses the vertical axis of the pivoting mechanism, it has become feasible to make the pivot angle on the boring and setting device be larger than 180° and extend to below the horizontal plane containing the pivot axis of the rollover, thus enabling bores near the floor to be realized by means of the same anchor boring and setting device. By that pivotal movement to below said horizontal plane it may be ensured that other, laterally arranged devices will not collide with the anchor boring and setting device, to which end the configuration preferably is devised such that means arranged below said horizontal plane, particularly the suction means, are designed to be pivotable within the range of pivotability of the anchor boring and setting device or reducible to a smaller cross section. The platform arranged behind the pivoting mechanism provides the space required by the operating personnel and, at the same time, an accordingly large manipulation space, to which end the configuration advantageously is devised such that further means, particularly energy supply means, are arranged on the platform behind a free space provided for the operation of the manipulator of the anchor boring and setting device.

Since the anchor boring and setting device is not coupled to the existing support of the driving machine, a high degree of flexibility is reached, whereby an optionally provided support of the driving machine itself may be realized in a plane located in the immediate vicinity of the anchor boring and setting device without causing any impediments during the manipulation of the anchor boring and setting device. The arrangement of the anchor boring and setting device substantially in the longitudinal central plane of the driving machine renders feasible to choose the anchor setting plane directly behind the horizontal pivoting mechanism while enabling anchoring patterns to be made over the entire sectional region as long as installations like, in particular, suction channels do not restrict the pivotal plane of the anchor boring and setting device. In order to enable such a wide pivotability, the configuration advantageously is devised such that suction duct parts projecting into the pivoting range comprise pivotable or displaceable walls which enable a reduction of the clear cross section of the suction duct by their pivotal movement or displacement, whereby an anchorage in the immediate vicinity of the pivoting mechanism is rendered feasible in that the rollover of the anchor boring and setting device is arranged above the pivoting mechanism. In order to enable anchoring simultaneously during driving without affecting the driving performance of the driving or mining machine in any manner whatsoever, the configuration advantageously is devised such that the cantilever arm is telescopically designed. In this manner, it is feasible to carry out several cuttings into the mine face from one and the same location of the machine without having to move the machine itself.

The optionally provided additional support of the driving or mining machine may be realized in a simple manner such that a supporting bolt capable of being adapted to the roof is arranged on pivotable carriers hinged to the frame behind the anchor boring and setting device. This support will, thus, only very slightly affect operations of the anchor boring and setting device and possible anchor patterns.

BRIEF DESCRIPTION OF THE DRAWINGS

In the following, the invention will be explained in more detail by way of an exemplary embodiment schematically illustrated in the drawing. Therein.

DETAILED DESCRIPTION OF PREFERRED EMBODIMENTS OF THE INVENTION

Figure 1:
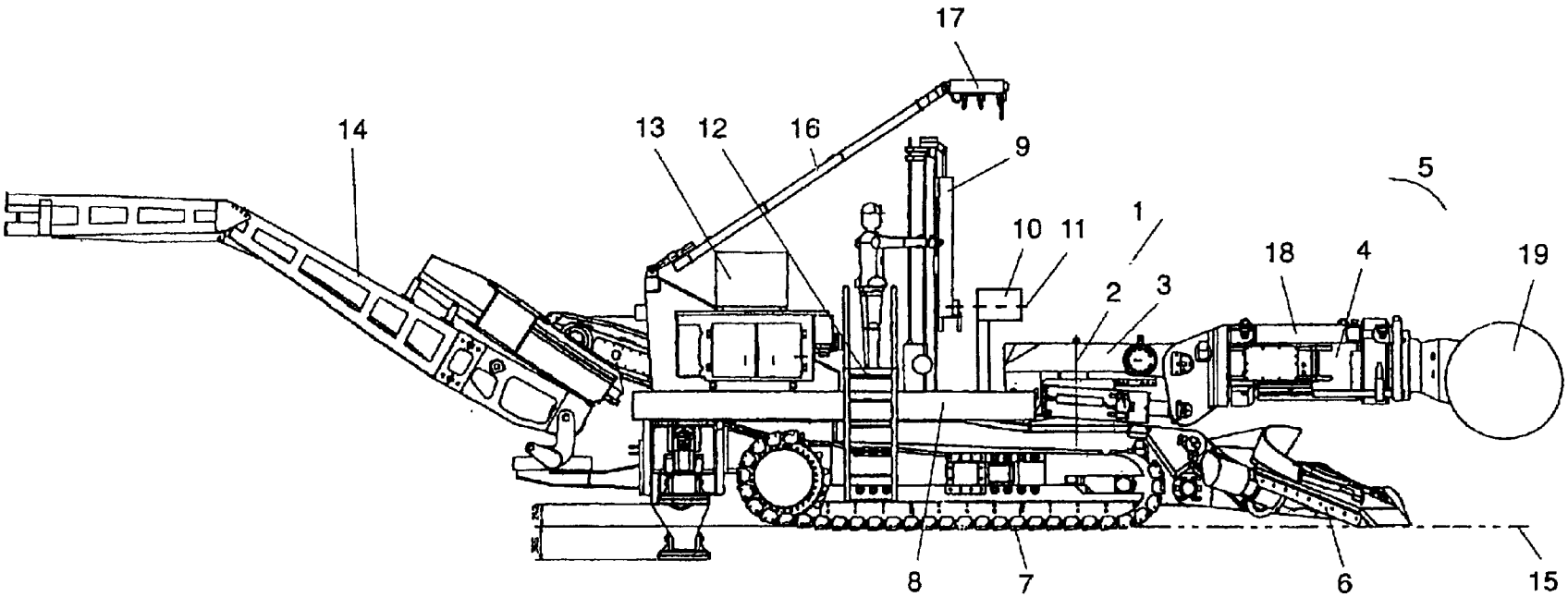
FIG. 1 is a lateral view of a driving or mining machine according to the invention with the anchor boring and setting device being in a substantially vertical position.

FIG. 1 illustrates a driving machine 1 to whose pivoting mechanism 3, which is pivotable about a vertical axis 2, a cantilever arm 4 is hinged so as to be pivotable in the height direction in the sense of double arrow 5. A loading means 6 is provided in the front region of the machine, whereby the machine itself is displaceable on a crawler mechanism 7. Behind the pivoting mechanism 3 is arranged a lowered platform 8 which provides the manipulation space required for an anchor boring and setting device 9. In the instant case, the anchor boring and setting device 9 on the platform 8 is hinged to a schematically indicated rollover 10 so as to be pivotable about an axis 11 that crosses the vertical pivot axis 2. On the rear end of the machine, energy supply means 13 are visible behind the operating platform 12, and an appropriate haulage means 14 is schematically illustrated to follow the machine. The anchor boring and setting device 9 may, thus, be placed into any desired position by being pivoted about the axis 11 of the rollover 10 and, in addition to offering the possibility of setting central roof anchors, also enables the realization of appropriate anchor bores, and the setting of anchors, about the periphery as far as to near the floor 15. A connecting rod 16 hinged to the rear region of the machine and to which a roof bolt 17 is pivotally fixed is also schematically illustrated. By pivoting the pivot arm 16 it is feasible to globally brace the machine 1 between roof and floor. The hewing arm 4 is telescopically designed where the respective actuating drive is schematically indicated by 18. To the front end of the hewing arm or cantilever arm 4 are attached cutter heads 19 which are equipped with cutting tools.

Figure 2:
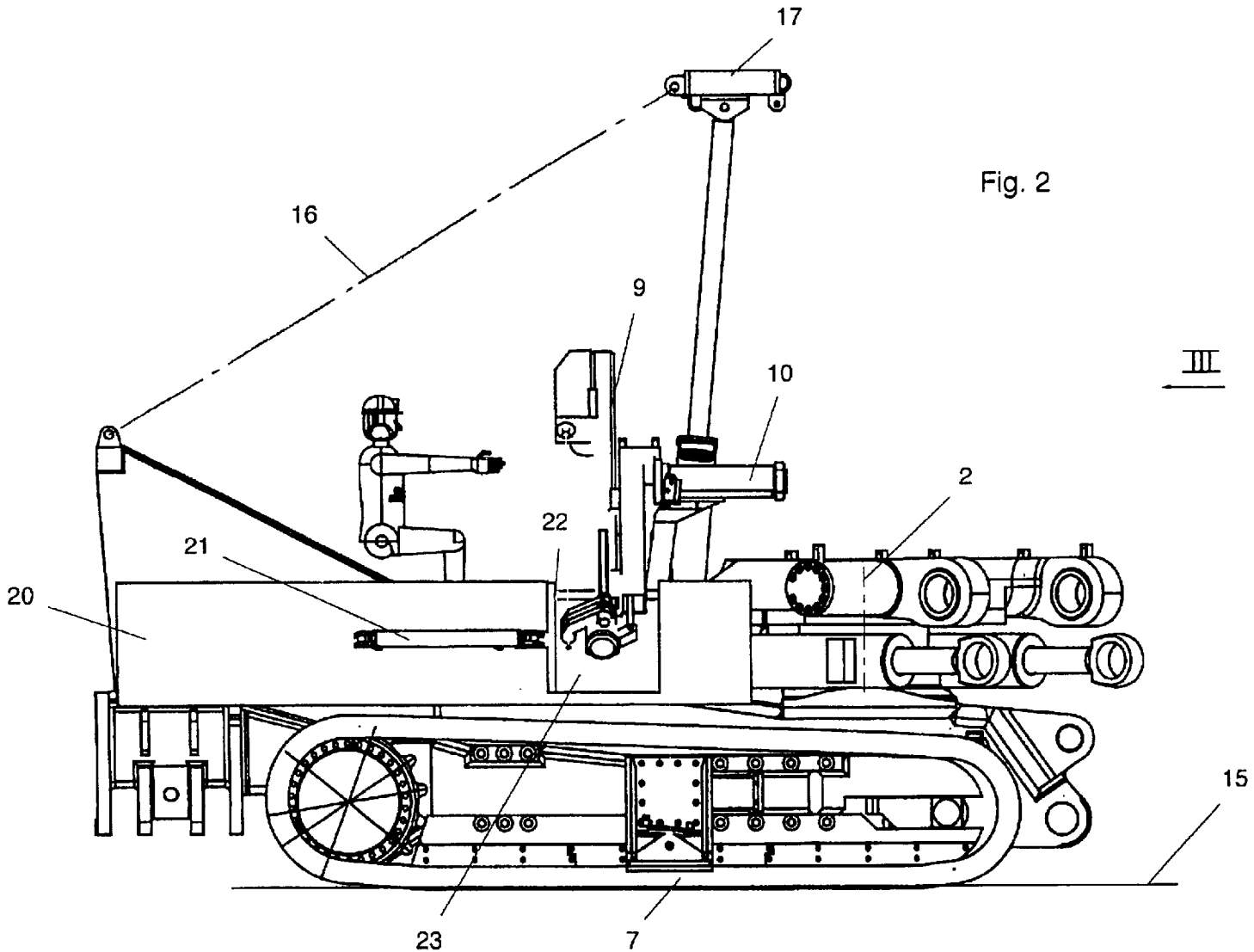
FIG. 2 depicts a modified driving machine in the illustration according to FIG. 1 with the anchor boring and setting device being pivoted.

In the illustration according to FIG. 2, in which some components of the machine as illustrated in FIG. 1 have been omitted for reasons of clarity, the reference numerals of FIG. 1 have been retained, and it is apparent that the suction-duct channel 20 laterally extending above the crawler mechanism 7 carries a hydraulic drive 21 capable of appropriately displacing a side wall of this channel 20. If a suitable transverse wall 23 is arranged in the region of this retractable wall element 22 of the suction channel 20, the retraction of this wall part 22 will result in the respective reduction of the clear cross section of the suction duct 20, that is available for sucking off, while the free space required to pivot the anchor boring and setting device 9 into a position as illustrated in FIG. 2 is, at the same time, provided such that anchors can be bored and set close to the floor 15.

Figure 3:
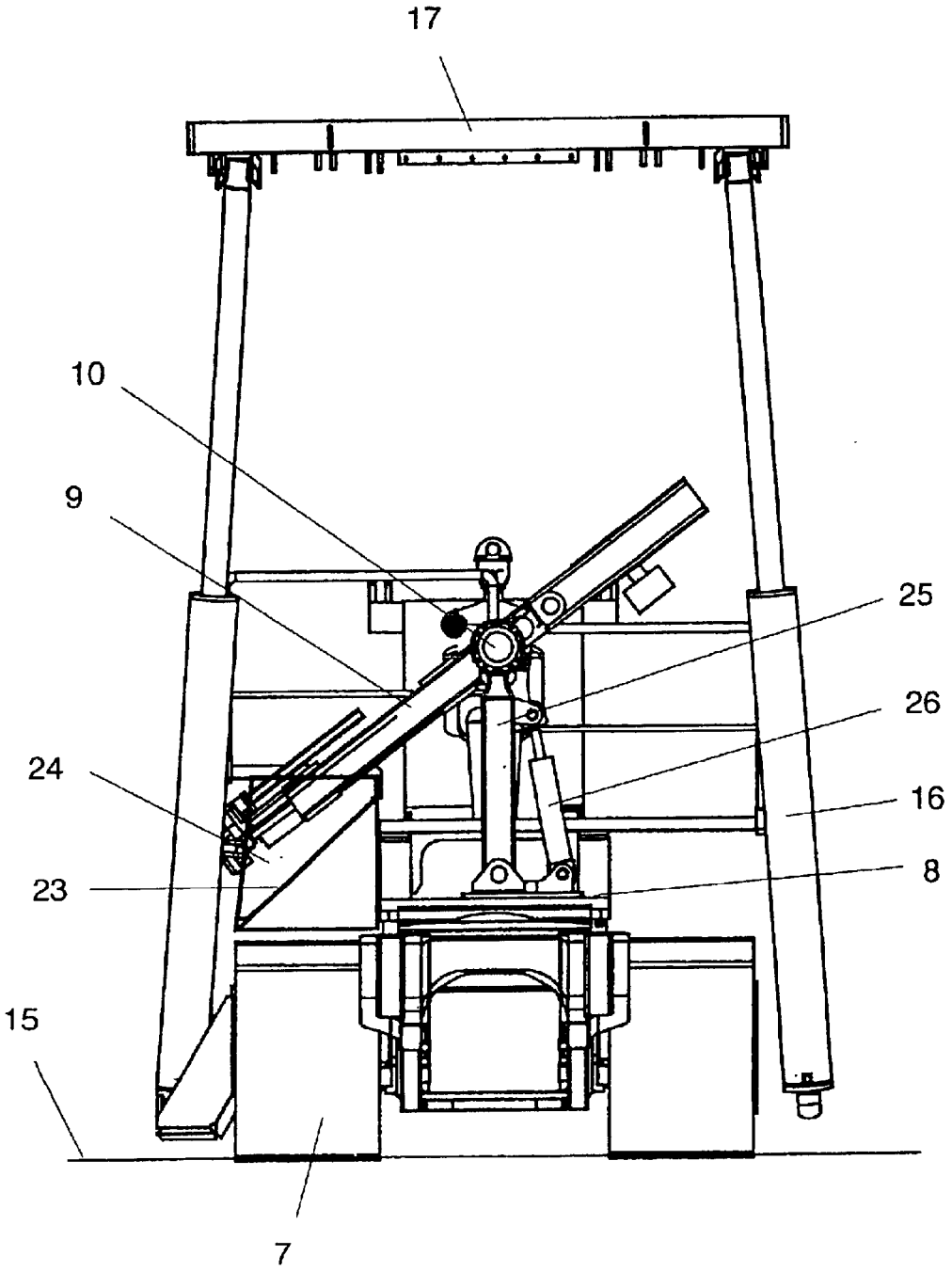
FIG. 3 is a view in the direction of the arrow III of FIG. 2.

The situation as illustrated in FIG. 2 becomes even more clearly apparent from the representation according to FIG. 3. The downwardly pivoted anchor boring and setting device 9 enters the space 24 cleared by the retraction of the wall element, so that downward pivotal movements aimed to realize lateral anchor bores near the floor 15 will not be impeded by any such means. The mounting itself of the rollover 10 is designed as a pivotal mounting in the instant case, with the carrying arm 25 of this mounting being accordingly pivotable out of the longitudinal central plane by means of a hydraulic cylinder piston unit 26 so as to further increase the number of possible anchor patterns.

What we claim is:

1. In a driving or mining machine of the type including a pivoting mechanism capable of being pivoted about a substantially vertical axis, a pivotable cantilever arm hinged to said pivoting mechanism so as to be pivotable in the height direction and having a free cantilever arm end, excavation tools rotationally mounted on the free end of the cantilever arm, a traveling mechanism, a frame supporting said traveling mechanism, a means for suction, and a means for anchor boring and setting arranged on said frame, the improvement wherein:

said frame is designed as a lowered platform on the side of said frame facing away from said cantilever arm behind said pivoting mechanism, said means for anchor boring and setting is arranged substantially in the longitudinal center of said frame above said lowered platform, said means for anchor boring and setting is pivotably mounted on a rollover having a pivot axis crossing the vertical axis of said pivoting mechanism, and said means for anchor boring and setting has a pivot angle larger than 180° and extending to below the horizontal plane of said pivot axis of said rollover.

2. A driving or mining machine as set forth in claim 1, wherein said means for suction is mounted below said horizontal plane.

3. A driving or mining machine as set forth in claim 2, wherein said means for suction is pivotably mounted below said horizontal plane, and is pivotable within the range of pivot of said means for anchor boring and setting.

4. A driving or mining machine as set forth in claim 2, wherein said means for suction is reducible to a smaller cross section.

5. A driving or mining machine as set forth in claim 1, further comprising a means for operating said means for anchor boring and setting, and means for supplying energy arranged on said lowered platform, behind a free space provided to operate said means for operating said means for anchor boring and setting.

6. A driving or mining machine as set forth in claim 1, wherein said means for suction is a suction duct having a clear cross section, with suction duct parts projecting into the pivoting range of said means for anchor boring and setting, wherein said suction duct parts include pivotable walls capable of being pivoted to reduce said clear cross section of said suction duct.

7. A driving or mining machine as set forth in claim 1, wherein said means for suction is a suction duct having a clear cross section, with suction duct parts projecting into said pivoting range of said means for anchor boring and setting, wherein said suction duct parts include displaceable walls capable of being displaced to reduce said clear cross section of said suction duct.

8. A driving or mining machine as set forth in claim 1, wherein said rollover of said means for anchor boring and setting is arranged above said pivoting mechanism.

9. A driving or mining machine as set forth in claim 1, wherein said cantilever arm is telescopically designed.

10. A driving or mining machine as set forth in claim 1, for use in a mine having a mine floor and a mine roof, further comprising one or more means for carrying hinged pivotably to said frame behind said means for anchor boring and setting, and means for support mounted on said pivotable means for carrying, and said means for support being capable of being engaged to said mine roof.

11. A driving or mining machine as set forth in claim 3, wherein said means for suction is reducible to a smaller cross section.

12. A driving or mining machine as set forth in claim 11, further comprising a means for operating said means for anchor boring and setting, and means for supplying energy arranged on said lowered platform, behind a free space provided to operate said means for operating said means for anchor boring and setting.

13. A driving or mining machine as set forth in claim 12, wherein said means for suction is a suction duct having a clear cross section, with suction duct parts projecting into the pivoting range of said means for anchor boring and setting, wherein said suction duct parts include pivotable walls capable of being pivoted to reduce said clear cross section of said suction duct.

14. A driving or mining machine as set forth in claim 13, wherein said means for suction is a suction duct having a clear cross section, with suction duct parts projecting into said pivoting range of said means for anchor boring and setting, wherein said suction duct parts include displaceable walls capable of being displaced to reduce said clear cross section of said suction duct.

15. A driving or mining machine as set forth in claim 14, wherein said rollover of said means for anchor boring and setting is arranged above said pivoting mechanism.

16. A driving or mining machine as set forth in claim 15, wherein said cantilever arm is telescopically designed.

17. A driving or mining machine as set forth in claim 16, for use in a mine having a mine floor and a mine roof, further comprising one or more means for carrying hinged pivotably to said frame behind said means for anchor boring and setting, and means for support mounted on said pivotable means for carrying, and said means for support being capable of being engaged to said mine roof.

18. A driving or mining machine as set forth in claim 1, wherein said excavation tools are cutter heads.

19. In a driving or mining machine of the type including a pivoting mechanism capable of being pivoted about a substantially vertical axis, a pivotable cantilever arm hinged to said pivoting mechanism so as to be pivotable in the height direction and having a free cantilever arm end, excavation tools rotationally mounted on the free end of the cantilever arm, a traveling mechanism, a frame supporting said traveling mechanism, a means for suction, and a means for anchor boring and setting arranged on said frame, the improvement wherein said frame is designed as a lowered platform on the side of said frame facing away from said cantilever arm behind said pivoting mechanism, and said means for anchor boring and setting is arranged substantially in the longitudinal center of said frame above said lowered platform.

20. A driving or mining machine as set forth in claim 19, wherein said excavation tools are cutter heads.

21. In a driving or mining machine for use in a mine having a mine floor and a mine roof, of the type including a pivoting mechanism capable of being pivoted about a substantially vertical axis, a pivotable cantilever arm hinged to said pivoting mechanism so as to be pivotable in the height direction and having a free cantilever arm end, excavation tools rotationally mounted on the free end of the cantilever arm, a traveling mechanism, a frame supporting said traveling mechanism, a means for suction, and a means for anchor boring and setting arranged on said frame, the improvement wherein said frame is designed as a lowered platform on the side of said frame facing away from said cantilever arm behind said pivoting mechanism, and said means for anchor boring and setting is arranged substantially in the longitudinal center of said frame above said lowered platform, and further comprising one or more means for carrying hinged pivotably to said frame behind said means for anchor boring and setting, and means for support mounted on said pivotable means for carrying, and said means for support being capable of being engaged to said mine roof.

22. A driving or mining machine as set forth in claim 21, wherein said means for suction is reducible to a smaller cross section.

23. A driving or mining machine as set forth in claim 21, wherein said excavation tools are cutter heads.

* * * * *